US006330900B1

(12) United States Patent
Welfonder

(10) Patent No.: US 6,330,900 B1
(45) Date of Patent: Dec. 18, 2001

(54) HOLDER FOR A DEPENDING ARCHITECTURAL COVERING

(75) Inventor: Konrad Welfonder, Bremerhaven (DE)

(73) Assignee: Hunter Douglas Industries BV (NL)

( * ) Notice: Subject to any disclaimer, the term of this patent is extended or adjusted under 35 U.S.C. 154(b) by 0 days.

(21) Appl. No.: 09/432,925

(22) Filed: Nov. 3, 1999

(30) Foreign Application Priority Data

| | | |
|---|---|---|
| Nov. 3, 1998 | (EP) | 98203694 |
| Feb. 11, 1999 | (EP) | 99200368 |
| Jul. 7, 1999 | (EP) | 99202210 |

(51) Int. Cl.[7] ..... E06B 9/36

(52) U.S. Cl. ..... 160/178.1 V; 160/177 V; 24/499

(58) Field of Search ..... 160/176.1 V, 168.1 V, 160/177 V, 178.1 V; 24/499; 16/87.2

(56) References Cited

U.S. PATENT DOCUMENTS

| | | | |
|---|---|---|---|
| 3,456,307 | * | 7/1969 | Love . |
| 3,486,549 | | 12/1969 | Rosenquist . |
| 3,500,511 | * | 3/1970 | Gloss . |
| 3,568,271 | * | 3/1971 | Saccoccio et al. . |
| 4,335,775 | | 6/1982 | Frentzel et al. . |
| 4,628,981 | | 12/1986 | Ciriaci et al. . |
| 4,869,309 | | 9/1989 | Evans . |

FOREIGN PATENT DOCUMENTS

| | | |
|---|---|---|
| 1230976 | 12/1966 | (DE) . |
| 2715018 | 10/1978 | (DE) . |
| 85231045 | 12/1985 | (DE) . |
| 3707030 | 9/1988 | (DE) . |

* cited by examiner

*Primary Examiner*—Blair M. Johnson
(74) *Attorney, Agent, or Firm*—Dorsey & Whitney LLP

(57) ABSTRACT

A holder for suspending a vertical section of an architectural covering from a carrier of a horizontally-extending head rail, the holder comprising a downwardly-extending first leg, a generally downwardly-extending second leg that is pivotally connected to the first leg for movement between a first position, in which it extends substantially parallel to the first leg, and a second position, in which it is at an acute angle to the first leg, the first leg having a first longitudinal side facing the second leg and the second leg having a second longitudinal side facing the first leg, one of the first and second longitudinal sides having a longitudinally-extending first notch and the other of the first and second longitudinal sides having a first shoulder projecting generally perpendicularly therefrom so as to be received in the first notch when the second leg is in the first position, the pivotal connection of the first and second legs extending laterally and being located above the first notch and the first shoulder. This first leg is adapted to be attached to the carrier at a point above the pivotal connection.

27 Claims, 11 Drawing Sheets

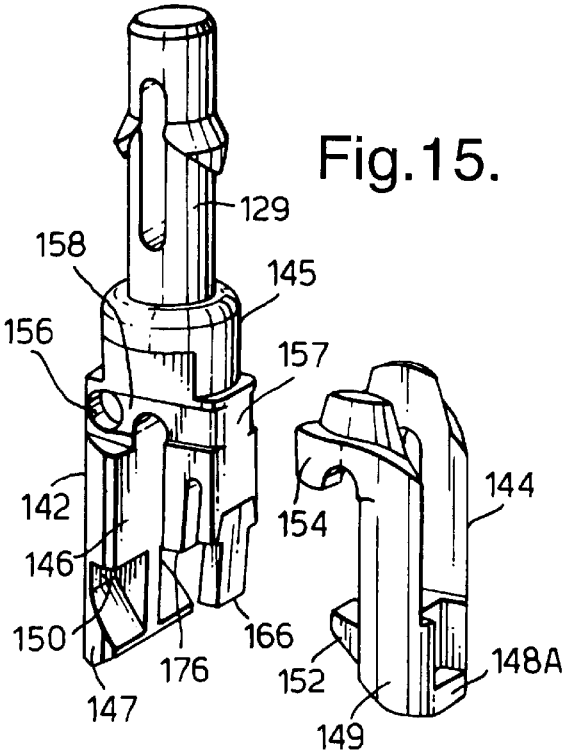
Fig.15.
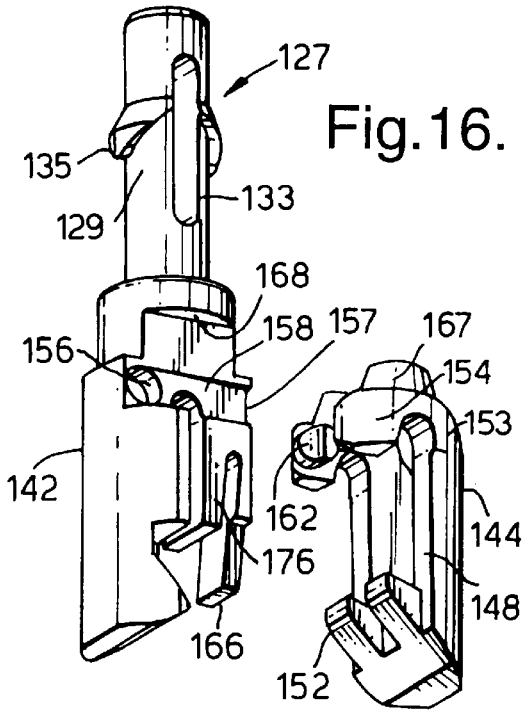
Fig.16.
Fig.17.
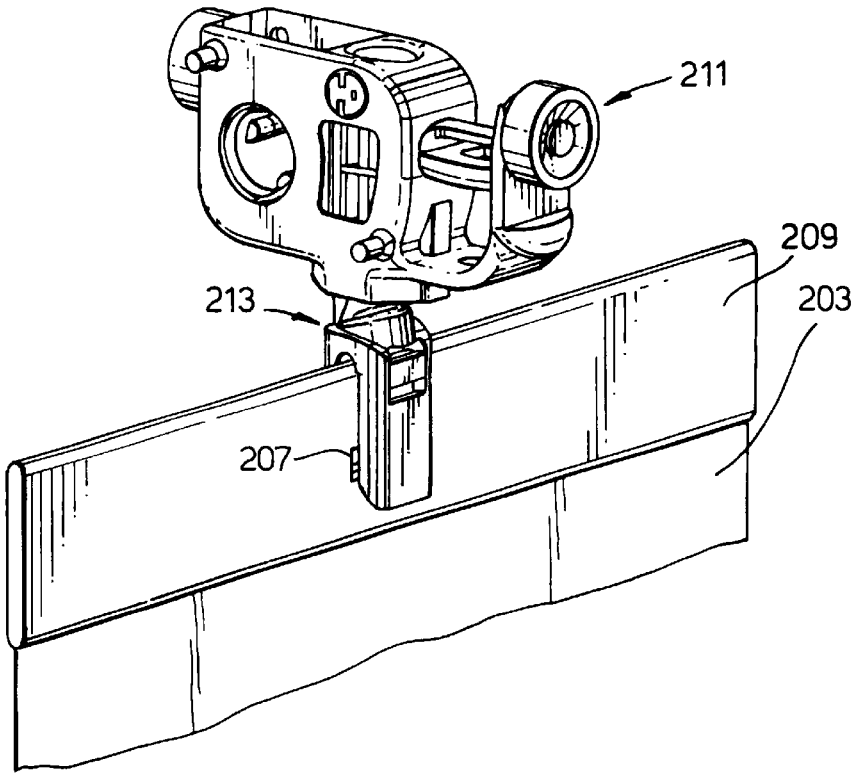

HOLDER FOR A DEPENDING ARCHITECTURAL COVERING

CROSS-REFERENCE TO RELATED APPLICATIONS

This application corresponds to and claims priority to European Application Nos. 98203694.9, filed Nov. 3, 1998; 98200368.1, filed Feb. 11, 1999; and 99202210.3, filed Jul. 7, 1999. These European applications are hereby incorporated by reference as though fully set forth herein.

BACKGROUND OF THE INVENTION a. Field of the Invention

This invention relates to a holder for a vertical section of an architectural covering, such as a drape or a vaned fabric for covering an architectural opening, like a window or door. This invention particularly relates to a holder for vertically arranged louvers of a louvered Venetian blind.

b. Background Art

Vertical Venetian blinds have generally been provided with a horizontally-extending head rail, in which there have been several carriers that can be moved along the length of the head rail. Each carrier has typically supported a vertically-extending louver in such a manner that the consumer of the Venetian blind could move the louver along the length of the head rail and also could rotate the louver about its vertical axis. For example, carriers have each included a drive hub of a gear wheel driven by a worm gear, and the drive hub has supported a depending louver holder that has been adapted to support securely the top portions of a louver while the carrier has been moving and turning the louver holder and the louver. See U.S. Pat. No. 4,335,775.

Different types of louver holders have been provided in carriers for vertical Venetian blinds. For example, louver holders have held upper marginal portions of louvers between their pairs of downwardly-extending pinching fingers. See German Gebrauchsmuster 85 23 104, German Offenlegungschrift 27 15 018 and U.S. Pat. No. 4,869,309. Louver holders have also held upper marginal portions of louvers on hooks that are provided on their downwardly-extending fingers and that extend through apertures in the upper marginal portions of the louvers. See U.S. Pat. No. 4,335,775. However, the grip of each of such louver holders on the upper marginal portions of the louvers has not always been sufficiently secure to suit the consumer. This has been a particular problem when louvers of different thicknesses of material have been used with the same holder and after louvers have had to be removed and replaced on the same holders.

There has continued to exist, therefore, a need for a holder which (i) is simple to make and install on a head rail, (ii) is simple to affix to a vertical section of an architectural covering and subsequently to detach from the vertical section, and (iii) securely affixes the vertical section to the head rail when the holder is used to move the vertical section along the length of the head rail or to rotate the section about its vertical axis.

BRIEF SUMMARY OF THE INVENTION

In accordance with this invention, a holder is provided for suspending a vertical section of an architectural covering from a carrier of a horizontally-extending head rail; the holder comprising:

a downwardly-extending first leg;

a generally downwardly-extending second leg that is pivotally connected to the first leg for movement between a first position, in which it extends substantially parallel to the first leg, and a second position, in which it is at an acute angle to the first leg;

the first leg having a first longitudinal side facing the second leg and the second leg having a second longitudinal side facing the first leg;

one of the first and second longitudinal sides, having a longitudinally extending first notch and the other of the first and second longitudinal sides having a first shoulder projecting generally perpendicularly therefrom so as to be received in the first notch when the second leg is in the first position;

the pivotal connection of the first and second legs extending laterally and being located above the first notch and the first shoulder; and means on the first leg, above the pivotal connection, for attaching the first leg to the carrier.

In accordance with an advantageous aspect of the holder of the invention, the first leg has a longitudinally-elongate intermediate portion that is above the first notch and the first shoulder and that has a pair of laterally opposite sides, through which the pivotal connection (A) passes; and the second leg has two parallel arms which are above the first notch and the first shoulder and which extend longitudinally at least to the pivotal connection. It is especially advantageous that one of: i) the pair of laterally opposite sides of the intermediate portion and ii) facing lateral side portions of the two parallel arms have a pair of recesses about the pivotal connection; and the other one of: i) the pair of laterally opposite sides of the intermediate portion and ii) facing lateral side portions of the two parallel arms have a pair of laterally-extending pivots along the pivotal connection; each pivot being laterally inserted in one of the recesses.

It is particularly advantageous that each parallel arm carries one of the pivots and has a longitudinal end with a polygonal, particularly rectangular, longitudinal profile, and each recess is vertically elongated whereby the pivots can be moved to vertical extremities of the recesses, so as to move the second leg downwardly relative to the first leg when the first shoulder is in the first notch. It is quite particularly advantageous that the longitudinal side of each recess, remote from the second leg, is open and wherein longitudinally adjacent the open longitudinal sides of the pair of recesses are means for resiliently abutting against the longitudinal ends of the arms when the pivots are inserted in the recesses, advantageously an upwardly-extending spring, so that the pivots are prevented from moving longitudinally outwardly of the recesses through their open longitudinal sides. It is more quite particularly advantageous that a vertically-extending second notch is in the bottom of one of the first notch and the first shoulder and a vertically-extending second shoulder is on the bottom of the other of the first notch and the first shoulder; the second shoulder being adapted to be inserted vertically into the second notch, when the second leg is in the first position, by moving the second leg downwardly relative to the first leg, whereby the second leg is prevented from moving from the first position to the second position.

It is also particularly advantageous that each parallel arm carries one of the pivots, each recess is generally round and advantageously, on the bottom of the intermediate member of the first leg, adjacent an opposite longitudinal side of the second leg, are means for resiliently abutting against the opposite longitudinal side of the second leg when the pivots are in the recesses, especially a downwardly-extending leaf spring, so that the second leg is resiliently held in the first position. It is quite particularly advantageous that the spring extends downwardly to about the first notch and is longitudinally biased towards the first notch to keep the first shoulder of the second leg biased towards the first notch.

It is further particularly advantageous that each parallel arm carries one of the pivots, each recess is generally round and advantageously, on the arms and especially also between the arms, are means for resiliently abutting against a laterally-extending upper stop on the first leg, above the recesses, especially a cantilever spring that extends longitudinally and upwardly away from the first leg, so that the second leg is resiliently held in the first position. It is quite particularly advantageous that a lower portion of the spring separates and reinforces a laterally bifurcated, upper portion of the second leg, on which are the arms. It is more quite particularly advantageous that the spring is a laterally bifurcated, cantilever spring, each tine of which is upwardly biased towards one of a pair of the upper stops on laterally opposite sides of the first leg.

It is still further particularly advantageous that each parallel arm carries one of the pivots, each recess is generally round and advantageously a sloped surface on the first leg above its recesses, especially on each of its laterally opposite sides, particularly at least directly above each recess, is inclined upwardly and laterally outwardly between the arms, and a collar, especially with a generally semicircular configuration, is on the second leg and has an interior surface, particularly on each of its laterally opposite sides, quite particularly at least directly above its pivots, which closely surrounds the sloped surface, so that the second leg is resiliently held in the first position. It is quite particularly advantageous that the sloped surface urges the interior surface of the collar and the arms to move laterally apart as the arms and the collar are pivoted about the recesses and pivots towards the second position.

In accordance with other aspects of the invention, a head rail for an architectural covering, such as a vertical blind, and an architectural covering are provided, comprising the holder, just described.

Further aspects of the invention will be apparent from the detailed description below of particular embodiments and the drawings thereof, in which:

BRIEF DESCRIPTION OF THE DRAWINGS

FIG. 15 is an exploded view of the holder of FIGS. 9–14 as shown in FIG. 14;

FIG. 16 is an exploded view of the holder of FIGS. 9–15 as shown in FIG. 13;

FIG. 17 is a perspective view of a carrier of the head rail of FIG. 1, supporting a single louver with a third embodiment of the holder of the invention;

In these Figures, corresponding parts in different embodiments are referred to by corresponding names and by the same last two reference numerals.

DESCRIPTION OF THE PREFERRED EMBODIMENTS

Figure 1:
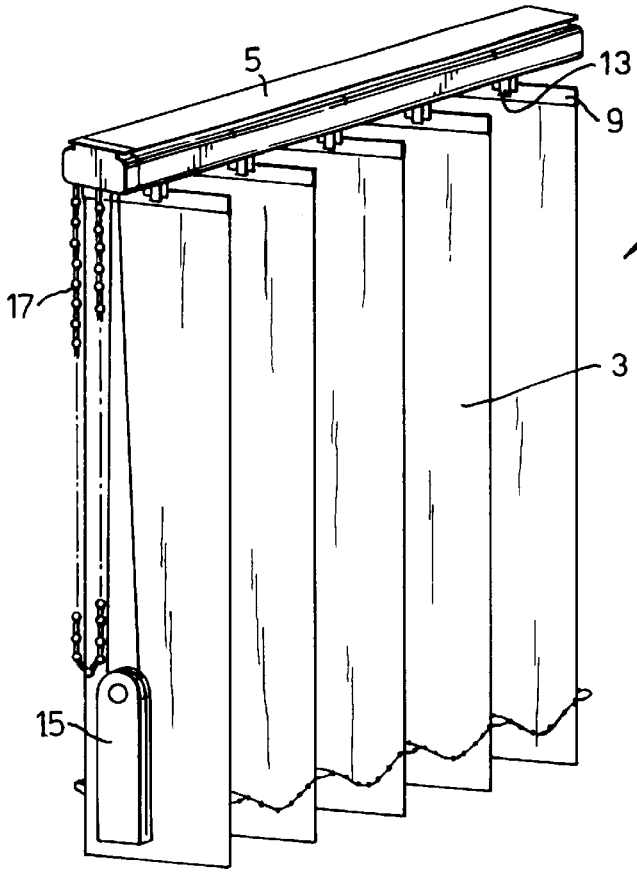
FIG. 1 is a perspective view of a vertical Venetian blind with a headrail that supports a plurality of vertical louvers by means of a plurality of holders of this invention.
Figure 2:
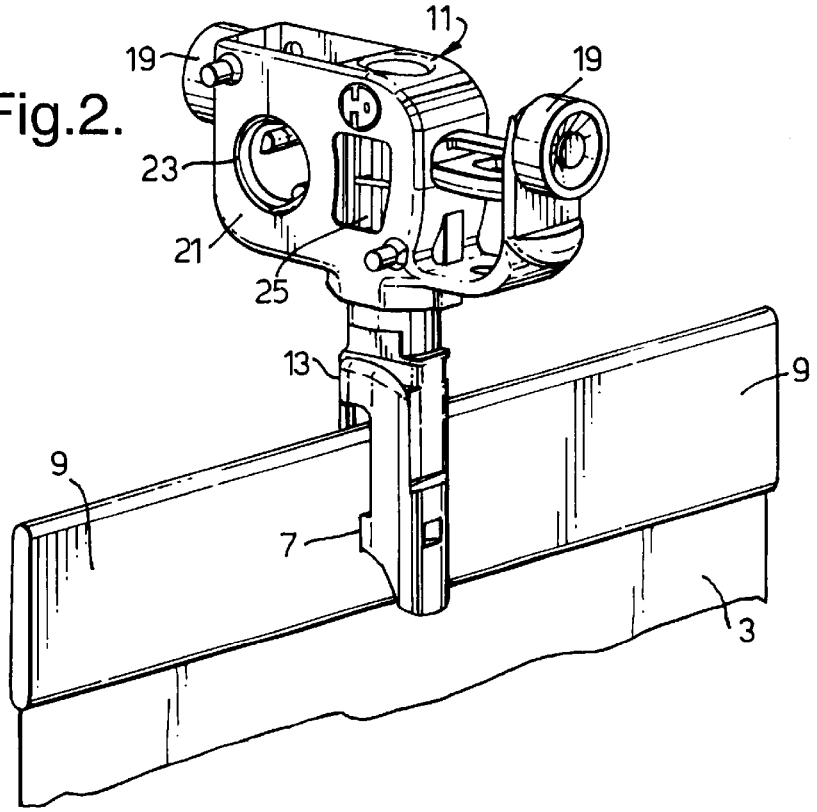
FIG. 2 is a perspective view of a carrier of the head rail of FIG. 1, supporting a single louver with a first embodiment of the holder of the invention.

FIGS. 1 and 2 show a vertical blind 1 having a plurality of vertical louvers 3 suspended from its horizontally-extending head rail 5. The louvers 3, shown in FIGS. 1 and 2, are conventional metal, plastic or fabric slats, each having an aperture 7, which may be reinforced against tearing, in its upper marginal portion 9. As described in detail below, each louver 3 is securely suspended vertically from one of a plurality of carriers, generally 11, of the head rail 5 by means of a vertically-extending holder, generally 13, of this invention. The holder 13, which is preferably made of plastic, is attached to the carrier 11 and to the aperture 7 of the louver 3 as shown in FIG. 2.

The head rail 5, shown in FIGS. 1 and 2, is generally described in U.S. Pat. No. 4,335,775 and provides controlled longitudinal movement of the carriers 11 and the vertical louvers 3 along the length of the head rail and controlled rotation of the vertical louvers 3 about their vertical axes. In this regard, one longitudinal side of the head rail is provided with a conventional pull cord 15 that is connected to the carriers 11 for moving them longitudinally along the length of the headrail 5. The one longitudinal side of the head rail 5 is also provided with a conventional bead chain 17 for rotating a longitudinally-extending drive shaft (not shown) of the head rail which can rotate a worm gear and its worm (not shown) within each carrier 11 so as to rotate the louvers 3. The carriers 11, as shown in FIG. 2, each have a pair of rollers 19 on opposite lateral sides of its housing 21, so that the carriers can roll on longitudinally-extending tracks (not shown) on laterally opposite sides of the interior of the head rail 5, along its length, in response to movement of the pull cord 15. The housing 21 of each carrier 11 has a pair of openings 23 on its longitudinally opposite sides, through which the drive shaft (not shown) of the head rail 5 passes to frictionally engage the worm gear (not shown) within the housing 21, so that rotation of the drive shaft causes rotation of the worm gear and thereby rotation of a drive gear 25 within the housing. A lower portion of the drive gear 25 includes a hollow vertically-extending hub (not shown), into which a vertically-extending upper part, generally 27, of the holder 13 of this invention, as shown in FIGS. 3–8, can be inserted, so that the carrier 11 supports the holder 13.

As shown in FIGS. 3–8, the upper part, generally 27, of the holder 13 has a pair of spaced vertically-extending upper arms 29 on longitudinally opposite sides. The arms 29 are joined at the top by a generally rounded bracket 31 and are separated, beneath the bracket 31, by an elongated laterally-extending slot 33. At the upper ends of the upper arms 29, below the bracket 31, are a pair of wedge-like projections 35, extending longitudinally in opposite directions. As in the vertical blind of U.S. Pat. No. 4,335,775, the upper part 27 of the holder 13 can be inserted into the hub of the drive gear 25 of each carrier 11 of the headrail 5, so that the holder is securely attached to, and suspended vertically from, the headrail 5 and can move with longitudinal movement of the carrier and rotate with rotation of the drive gear.

Figure 6:
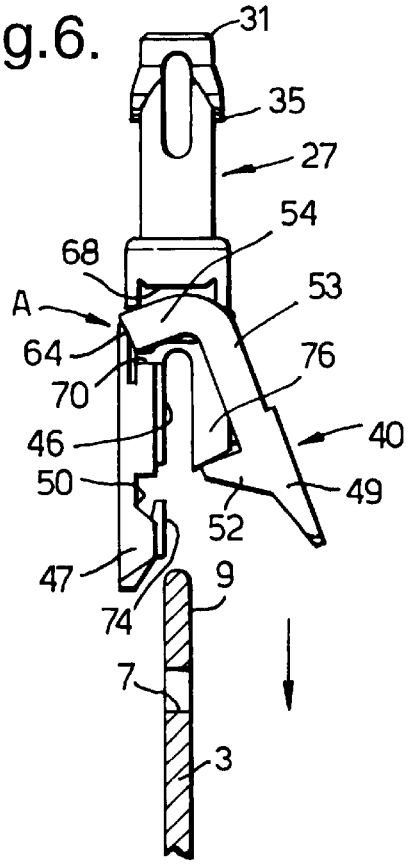
Figure 7:
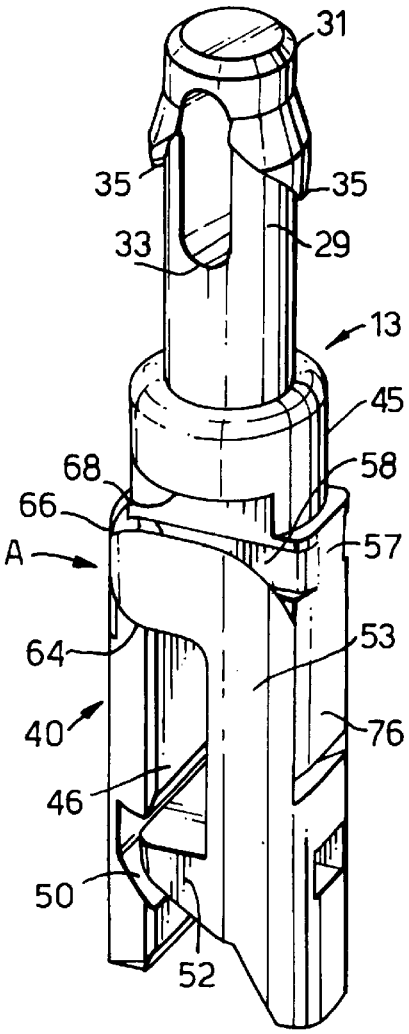
FIG. 7 is a perspective view of the holder of FIGS. 2–6, partly from above and partly from the side.
Figure 8:
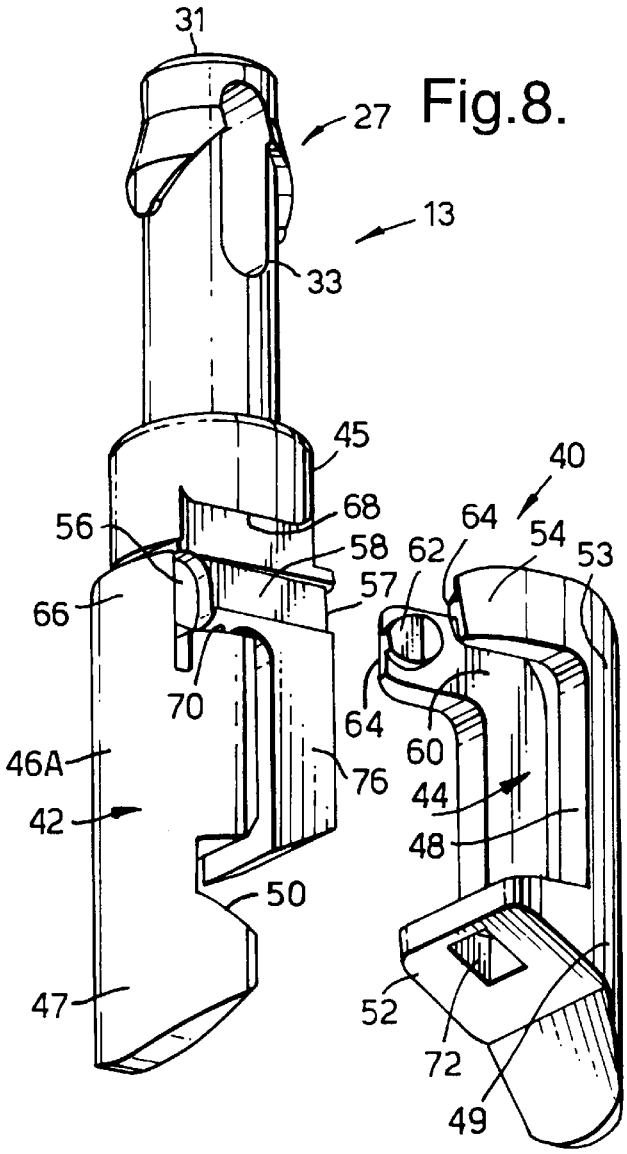
FIG. 8 is an exploded view of the holder of FIGS. 2–7, partly from beneath and rotated 90 from its position in FIG. 7.

As also shown in FIGS. 3–8, a vertically-extending lower part, generally 40, of the holder 13 has a downwardly-extending first leg 42 and a generally downwardly-extending second leg 44. An upper portion 45 of the first leg 42 of the lower part 40 of the holder 13 is rigidly fixed to the bottom of the upper part 27 of the holder, and the first leg 42 and the upper part 27 of the holder preferably comprise one piece. The first and second legs 42 and 44 are separate pieces that are pivotally connected, so that the second leg 44 can move relative to the first leg 42 between: a first or closed position shown in FIGS. 3–5, in which the second leg extends downwardly, substantially parallel to the first leg; and a second or open position, shown in FIG. 6, in which the second leg is at an acute angle to the first leg. The first and second legs 42 and 44 have first and second, longitudinal sides 46 and 48, respectively, facing each other. A first, vertically elongate, longitudinally-extending notch 50 is provided in the first longitudinal side 46 of a lower portion 47 of the first leg 42, and a first longitudinally-extending shoulder 52 projects generally perpendicularly from the second longitudinal side 48 of a lower portion 51 of the second leg 44. Preferably, the upper portion 53 of the second leg 44, above its longitudinally-extending shoulder 52, is laterally bifurcated as seen in FIG. 8. The longitudinally-extending shoulder 52 is adapted to be received in the longitudinally-extending notch 50 when the second leg 44 is in its closed position, substantially parallel to the first leg 42 and downwardly extending as shown in FIGS. 2, 3–5 and 7. In this regard, the longitudinally-extending shoulder 52 of the second leg 44 of the carrier 13 can be inserted through the aperture 7 in the upper marginal portion 9 of a vertical louver 3, before being received and held in the longitudinally-extending notch 50 in the first leg 42 of the carrier 13, to securely support vertically the louver 3 from the headrail 5 of the vertical blind 1.

Figure 5:
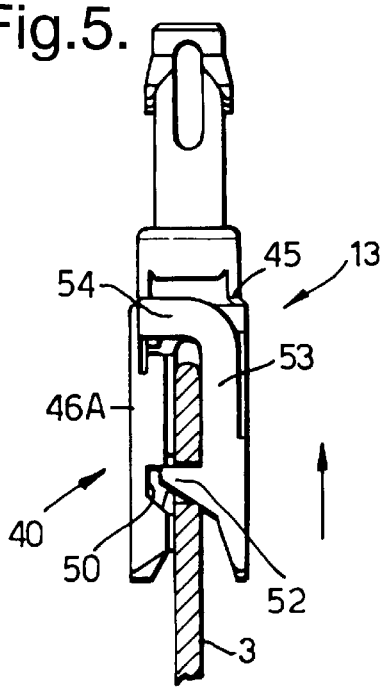

The pivotal connection, generally A, of the second leg 44 to the first leg 42 of the lower part 40 of the holder 13 is best seen from FIG. 8. This pivotal connection A extends laterally and is above the longitudinally-extending notch 50 and longitudinally-extending shoulder 52 of the first and second legs 42, 44. The pivotal connection A is provided by a pair of laterally spaced, parallel, lower arms 54 which are upper extensions of the laterally bifurcated, upper portion 53 of the second leg 44, which are above the longitudinally-extending shoulder 52 of the second leg, and which extend generally longitudinally to a pair of elongate vertically-extending recesses 56. The vertically-extending recesses 56 are located adjacent an opposite longitudinal side 46A of the first leg 42 and in laterally opposite sides of a longitudinally-elongate intermediate portion 57 of the first leg 42. The intermediate portion 57 is located above the longitudinally-extending notch 50 of the lower portion 47 of the first leg 42 and below its upper portion 45. The longitudinal side of each vertically-extending recess 56, along the opposite longitudinal side 46A of the first leg 42, remote from the second leg 44, is preferably open. Upper portions of each vertically-extending recess 56, on its other longitudinal side, closer to the second leg 44, communicate with one of a pair of grooves 58 that are provided in the laterally opposite sides of the intermediate portion 57 of the first leg 42, above its longitudinally-extending notch 50, and that extend longitudinally along the entire length of the intermediate portion 57. Facing lateral side portions 60 of the lower arms 54 of the second leg 44 face the vertically-extending recesses 56 and longitudinally-extending grooves 58 of the intermediate portion 57 of the first leg 42 and carry a pair of confronting, laterally-extending pivots 62 which are preferably round. The pivot 62 of each lower arm 54 is laterally inserted in one of the vertically-extending grooves 56, so that the pivots 62 and the second leg 44 can freely rotate about the pivotal connection A when the pivots 62 are positioned in the upper portions of the vertically-extending recesses 56 of the first leg 42 as shown in FIGS. 5 and 6. Because the pair of vertically-extending recesses 56 of the first leg 42 are vertically elongated, the pivots 62 of the second leg 44 can be moved downwardly in these recesses, so as to move the second leg downwardly relative to the first leg 42.

As also seen from FIGS. 7 and 8, the lateral side portions 60 and the pivots 62 of the second leg 44 are preferably adjacent to the longitudinal ends 64 of its lower arms 54, remote from its second longitudinal side 48. Each of the longitudinal ends 64 of the lower arms 54 preferably has a polygonal, especially a rectangular, longitudinal profile.

As further seen from FIGS. 7 and 8, an upwardly-extending leaf spring 66 is provided on top of the opposite longitudinal side 46A of the first leg 42, above its longitudinally-extending notch 50. The spring 66 is longitudinally adjacent the open longitudinal sides of the vertically-extending recesses 56 and is longitudinally biased towards the vertically-extending recesses, so that the spring resiliently abuts against the longitudinal ends 64 of the lower arms 54. As a result, the spring 66 keeps the pivots 62 on the lower arms 54 from moving longitudinally out of the vertically-extending recesses 56, through their open longitudinal sides, particularly when the longitudinal ends 64 of the lower arms are moved longitudinally along the longitudinally-extending grooves 58, towards the spring 66, to insert their pivots 62 in the upper portions of the vertically-extending recesses 56.

Figure 3:
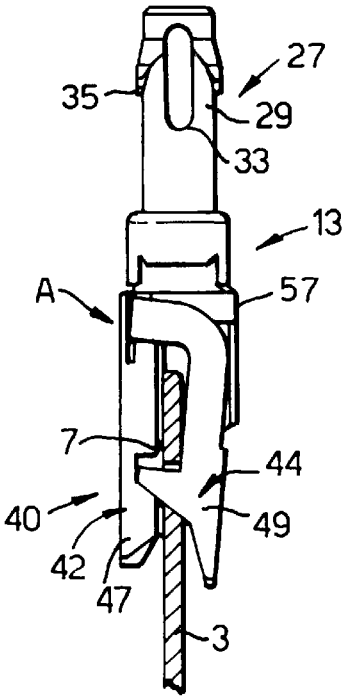
FIGS. 3–6 are side views of the holder of FIG. 2, showing how it can be secured to, and disengaged from, the louver of FIGS. 1 and 2.
Figure 4:
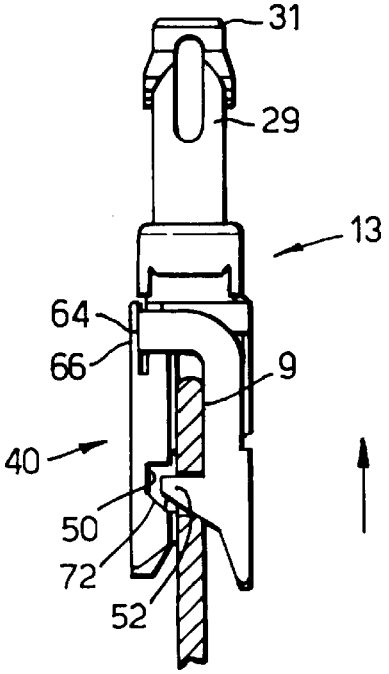

FIGS. 7 and 8 also show a pair of laterally-extending upper stops 68 and a pair of laterally-extending lower stops 70, provided on laterally opposite sides of the first leg 42, above and below its pairs of vertically-extending recesses 56 and longitudinally-extending grooves 58. The lower stops 70 are adapted to abut against the bottom surfaces of the lower arms 54 to limit the downward movement of the pivots 62 of the lower arms in the vertically-extending recesses 56 as shown in FIG. 3. The upper and lower stops 68 and 70 are also adapted to abut against the top and bottom surfaces respectively of the lower arms 54 to limit the upward pivoting of the lower arms 54 about their pivots 62 when the pivots are in the upper portions of the vertically-extending recesses 56 as shown in FIGS. 5–6. The lower stops 70 and the spring 66 are also adapted to abut against the bottom surfaces of the lower arms 54 and the longitudinal surfaces of their longitudinal ends 64 respectively to hinder upward pivoting of the lower arms 54 about their pivots 62 when the pivots are in the lower portions of the vertically-extending recesses 56 as shown in FIGS. 3–4.

As best seen from FIG. 8, a second vertically-extending notch 72 is provided in the bottom of the first longitudinally-extending shoulder 52 at about its lateral middle and preferably at about its longitudinal middle. As best seen from FIG. 6, a second vertically-extending shoulder 74 is provided on the bottom of the first longitudinally-extending notch 50 at about its lateral middle, preferably adjacent the first longitudinal side 46 of the first leg 42. The vertically-extending shoulder 74 is adapted to be inserted vertically into the vertically-extending notch 72 when the longitudinally-extending shoulder 52 is in the longitudinally-extending notch 50 and the first and second legs 42 and 44 are closed as shown in FIGS. 3–5 and 7. Inserting the vertically-extending shoulder 74 vertically into the vertically-extending notch 72 can be accomplished simply by moving the second leg 44 downwardly relative to the first leg 42 as shown starting in FIG. 5 and ending in FIG. 3. This can be easily done because the pivots 62 of the lower arms 54 of the second leg 44 can be moved downwardly in the vertically-extending recesses 56 of the first leg 42, so as to move the second leg downwardly relative to the first leg, when the longitudinally-extending a shoulder 52 is in the longitudinally-extending notch 50 and the first and second legs 42 and 44 are closed.

Inserting the vertically-extending shoulder 74 vertically into the vertically-extending notch 72 serves to lock the longitudinally-extending shoulder 52 in the longitudinally-extending notch 50 and thereby to lock the first and second legs 42 and 44 of the holder 13 in the closed position shown in FIG. 3. In this regard, the lower stops 70 and the spring 66 of the first leg 42 of the holder abut against the bottom surfaces of the lower arms 54 and the longitudinal surfaces of their longitudinal ends 64 to hinder upward pivoting of the lower arms 54 about their pivots 62 in the closed position of the holder. As a result, the holder 13, in its closed position, can securely hold the louver 3 in a vertically extended position from the carrier 11 of the head rail 5, with the longitudinally-extending shoulder 52 of the holders second leg 44 being inserted into the aperture 7 in the upper marginal portion 9 of the louver and then into the longitudinally-extending notch 50 of the first leg 42.

As also best seen from FIG. 8, a guide member 76 extends downwardly from the longitudinal end of the intermediate member 57 of the first leg 42, remote from the vertically-extending recesses 56. The guide member 76 fits closely between the two parts of the laterally bifurcated, upper portion 53 of the second leg 44 and serves to maintain their separation when the second leg pivots relative to the first leg 42 from its open position to its closed position.

FIGS. 9–16 show a second embodiment of a holder 113 of the invention, which is similar to the holder 13 of FIGS. 1–8 and for which corresponding reference numerals (greater by 100) are used below for describing the corresponding parts.

Figure 9:
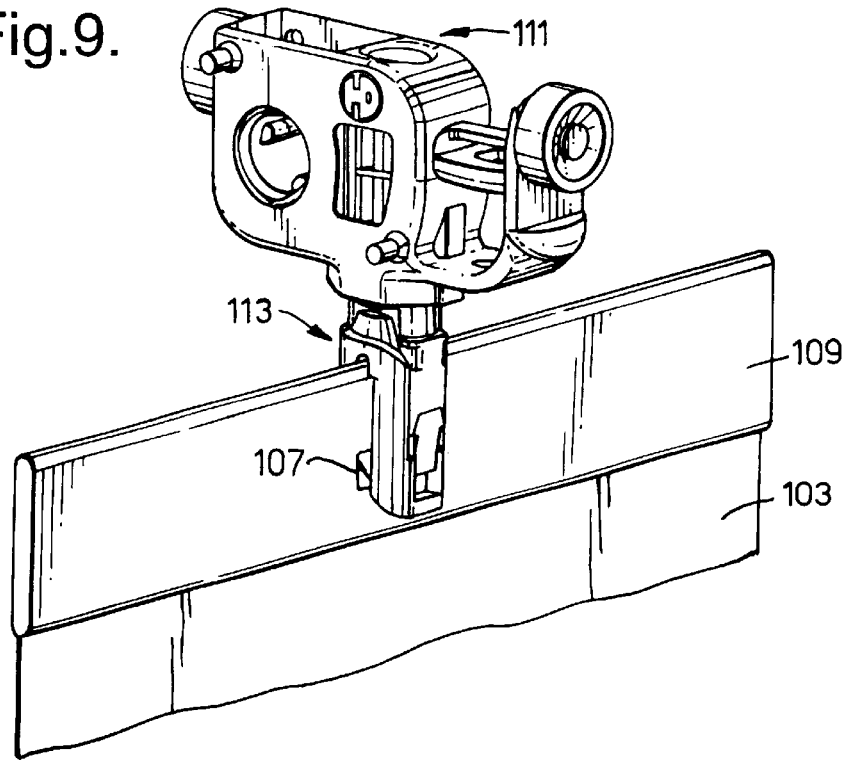
FIG. 9 is a perspective view of a carrier of the head rail of FIG. 1, supporting a single louver with a second embodiment of the holder of the invention.
Figure 13:
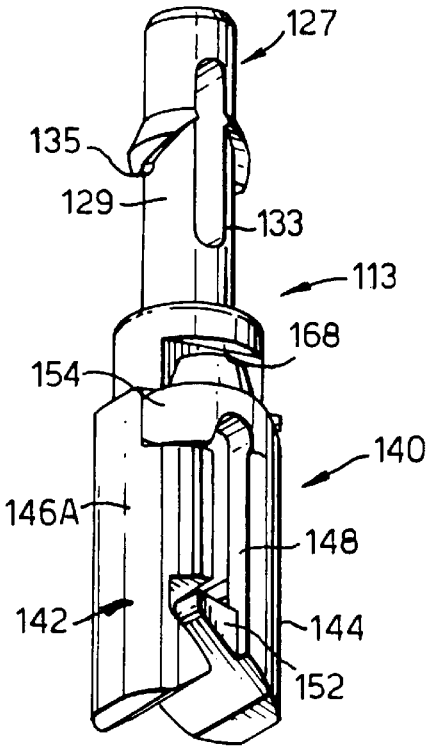
FIG. 13 is a perspective view of the holder of FIGS. 9–12, partly from beneath and partly from the side.
Figure 14:
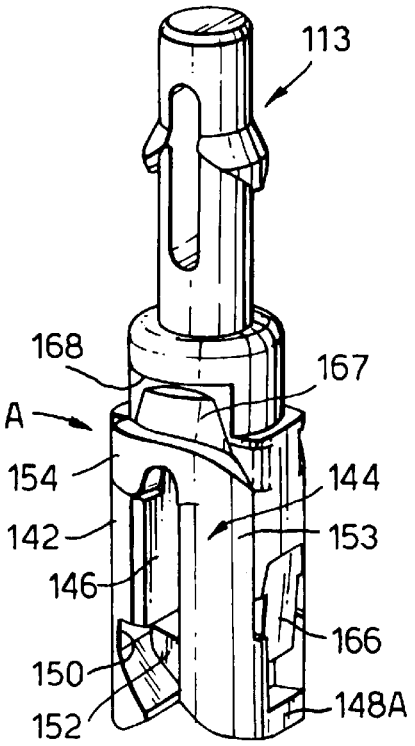
FIG. 14 is a perspective view of the holder of FIGS. 9–12, partly from above and rotated 90 from its position in FIG. 13.

FIG. 9 shows a vertical louver, generally 103, of a vertical blind 101 (not shown). The louver 103 is securely suspended from a carrier, generally 111, of a head rail 105 (not shown) by means of a vertically-extending holder 113 which is attached to the carrier 111 and to an aperture 107 in the upper marginal portion 109 of the louver.

Figure 10:
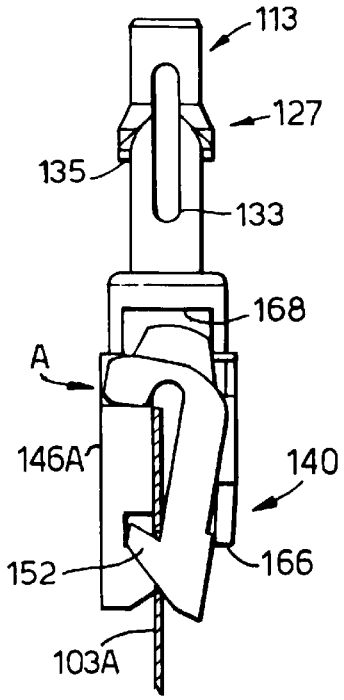
FIGS. 10–12 are side views of the holder of FIG. 9, showing how it can be secured to, and disengaged from, the louver of FIGS. 1 and 9.
Figure 11:
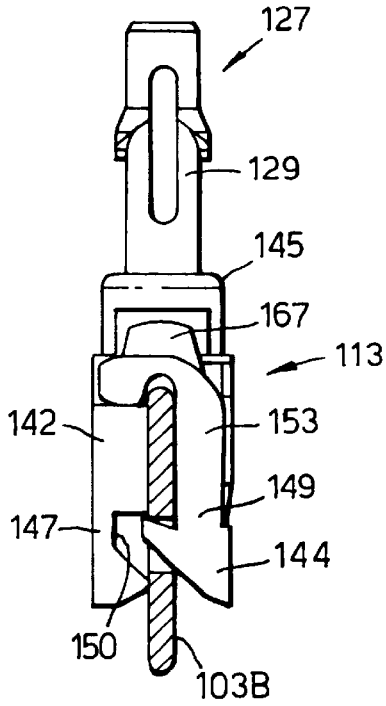

FIGS. 10–16 show an upper part 127 of the holder 113 and a vertically-extending lower part 140 of the holder, holding the louver 103. The lower part 140 of the holder 113 has pivotally-connected, first and second legs 142, 144 which, as shown in FIGS. 10 and 11, can accommodate and securely hold a relatively thin louver 103A or a relatively thick louver 103B between them. An upper portion 145 of the first leg 142 is rigidly fixed to the bottom of the upper part 127 of the holder, and the first leg 142 and the upper part 127 of the holder preferably are one piece. A first vertically-elongate longitudinally-extending notch 150 is provided in a first longitudinal side 146 of a lower portion 147 of the first leg 142, and a first longitudinally-extending shoulder 152 projects generally perpendicularly from a second longitudinal side 148 of a lower portion 149 of the second leg 144. The first shoulder 152 is adapted to be received in the first notch 150 when the second leg 144 is in its closed position, substantially parallel to the first leg 142 and downwardly-extending as shown in FIGS. 9, 10, 13 and 14.

Figure 12:
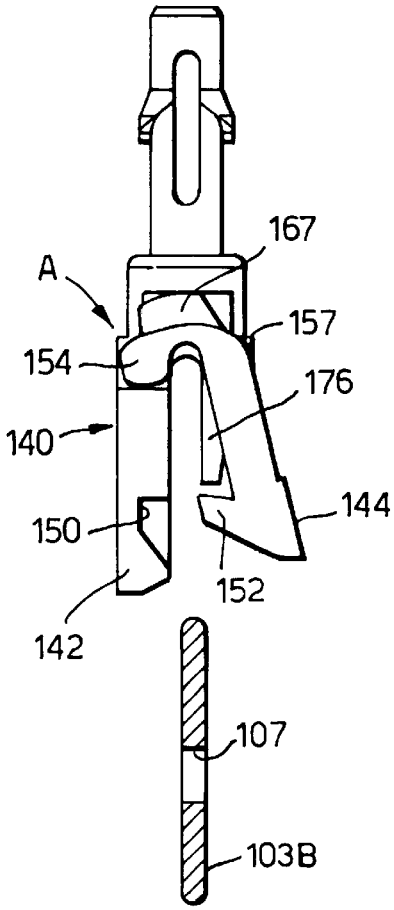

The pivotal connection, generally A, of the first and second legs 142, 144 of the holder 113 is best seen from FIGS. 15 and 16. This pivotal connection A is provided by a pair of parallel lower arms 154 which are upper extensions of a laterally bifurcated, upper portion 153 of the second leg 144, which are above its first shoulder 152 and which extend generally longitudinally to a pair of round or circular recesses 156. The round recesses 156 are in laterally opposite sides of a longitudinally-elongate intermediate portion 157 of the first leg 142, above its first notch 150, and are adjacent an opposite longitudinal side 146A of the first leg. The longitudinal side of each round recess 156, along the opposite longitudinal side 146A of the first leg 142, remote from the second leg 144, is closed. Each recess 156, on its other longitudinal side, closer to the second leg 144, communicates with one of a pair of longitudinally-extending grooves 158 in laterally opposite sides of the intermediate portion 157 of the first leg 142. A laterally-extending, preferably round pivot 162 of each lower arm 154 is laterally inserted in one of the recesses 156, so that the pivots 162 and the second leg 144 can freely rotate about the pivotal connection A and relative to the first leg 142 as shown in FIGS. 10–12.

As also seen from FIGS. 10 and 14–16, a leaf spring 166 extends downwardly from the longitudinal end of the intermediate portion 157 of the first leg 142, remote from the round recesses 156 and adjacent an opposite longitudinal side 148A of the second leg 144. The spring 166 is parallel to the first longitudinal side 146 of the first leg and extends downwardly to about the first notch 150. The spring 166 is longitudinally biased towards the first notch 150, so that the spring resiliently abuts against the opposite longitudinal side 148A of the second leg 144. As a result, the spring 166 keeps the first shoulder 152 of the second leg 144 biased longitudinally towards the first notch 150 of the first leg 142, thereby keeping the second leg 144 biased longitudinally towards the first leg 142 and biased towards the closed position of the holder 113. In this regard, the spring 166 can serve to keep different thicknesses of louver 103 clamped securely between the legs 142, 144 (see FIGS. 10–12) and also to restrain swivelling of the louver about its vertical axis.

Preferably, the longitudinally-extending first shoulder 152 extends upwardly somewhat towards the first leg 142 in a closed position of the holder 113 as shown in FIGS. 10–11. Thereby, once the upper marginal portion 109 of the louver 103 is inserted between the legs 142, 144 and the first shoulder 152 is inserted through the aperture 107 in the upper marginal portion of the louver, the weight of the louver on the first shoulder will cause the second leg 144 to be biased towards the first leg 142. This will cause the first shoulder to be urged inwardly of the longitudinally-extending first notch 150 and will further bias the second leg 144 towards the closed position of the holder 113.

As further seen from FIGS. 12 and 14–16, a guide member 176 extends downwardly from the intermediate portion 157 of the first leg 142, between the recesses 156 and the spring 166. The guide member 176 fits closely between the two parts of the laterally bifurcated, upper portion 153 of the second leg 144 and serves to maintain their separation when the second leg pivots relative to the first leg 142 from its open position to its closed position.

As still further seen from FIGS. 10–16, a pair of laterally-extending upper stops 168 are provided on laterally opposite sides of the upper portion 145 of the first leg 142, above its pairs of recesses 156 and grooves 158. The upper stops 168 are adapted to abut against the top surfaces of the lower arms 154 to limit their upward pivoting about the pivots 162 as shown in FIG. 12. In this regard, an upstanding laterally-extending ridge 167 is provided on top of each lower arm 154. The ridges 167 are adapted to abut against the upper stops 168, so as to limit further the upward pivoting of the lower arms about the pivots 162.

In addition, the spring 166 of the first leg 142 also abuts against the opposite longitudinal side 148A of the second leg 144 to hinder its upward pivoting by continuously urging it longitudinally towards the first leg. As a result, the second leg 144 is continuously biased downwardly to the closed position of the holder 113 where it can securely hold the louver 103 in a vertically extended position from the carrier 111 of the head rail 105, with the first shoulder 152 of the holders second leg 144 being inserted longitudinally into the aperture 107 in the upper marginal portion 109 of the louver and then into the first notch of the first leg 142.

FIGS. 17–24 show a third embodiment of a holder 213 of the invention, which is similar to the holder 13 of FIGS. 1–8 and for which corresponding reference numerals (greater by 200) are used below for describing the corresponding parts.

FIG. 17 shows a vertical louver, generally 203, of a vertical blind 201 (not shown). The louver 203 is securely suspended from a carrier, generally 211, of a head rail 205 (not shown) by means of the vertically-extending holder 213 which is attached to the carrier 211 and to an aperture 207 in the upper marginal portion 209 of the louver.

Figure 18:
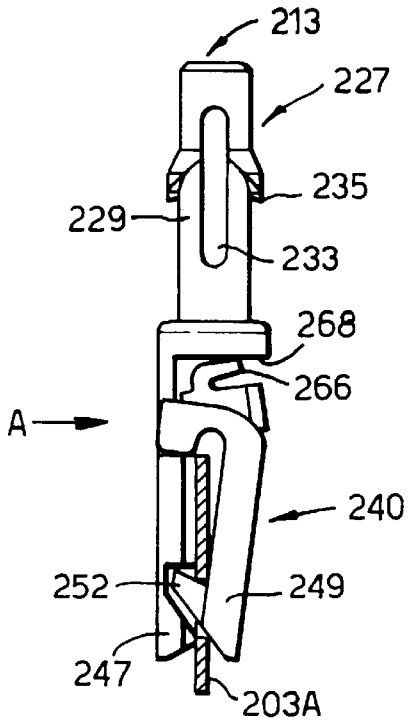
FIGS. 18–20 are side views of the holder of FIG. 17, showing how it can be secured to, and disengaged from, the louver of FIGS. 1, 9 and 17.
Figure 19:
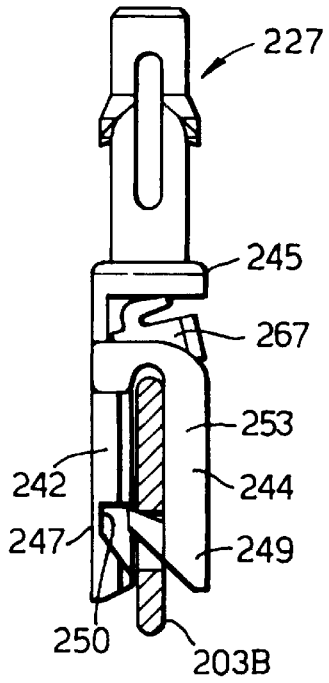

FIGS. 18–24 show an upper part 227 of the holder 213, held by the carrier 211, and a vertically-extending lower part 240 of the holder 213, holding the louver 203. The lower part 240 has pivotally-connected, first and second legs 242,244 which, as shown in FIGS. 18 and 19, can accommodate and securely hold a relatively thin louver 203 A or a relatively thick louver 203B between them. An upper portion 245 of the first leg 242 of the holder 213 is rigidly fixed to the bottom of the upper part 227 of the holder, and the first leg 242 and the upper part 227 of the holder preferably comprise one piece. A first vertically-elongate longitudinally-extending notch 250 is provided in a first longitudinal side 246 of a lower portion 247 of the first leg 242, and a first longitudinally-extending shoulder 252 projects generally perpendicularly from a second longitudinal side 248 of a lower portion 249 of the second leg 244. The first shoulder 252 is adapted to be received in the first notch 250 when the second leg 244 is in its closed position, substantially parallel to the first leg 242 and downwardly-extending as shown in FIGS. 17, 18, 21 and 23.

Figure 20:
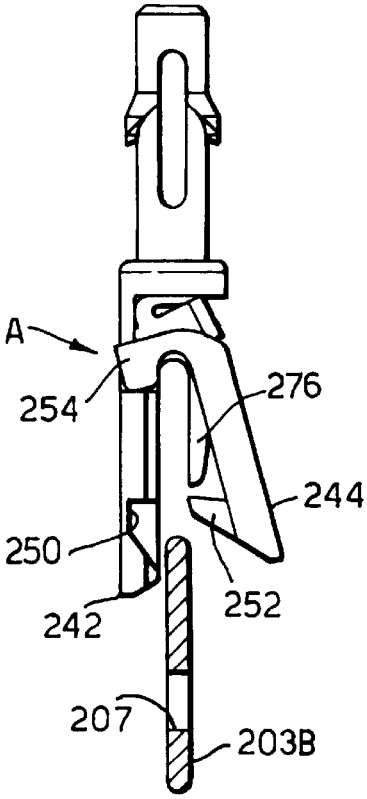
Figure 21:
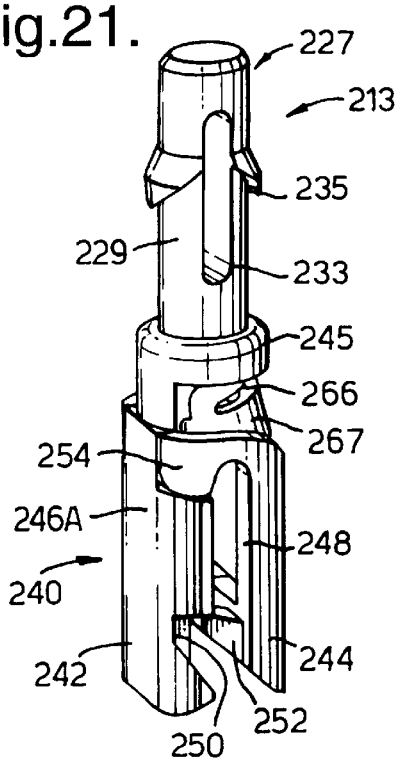
FIG. 21 is a perspective view of the holder of FIGS. 17–20, partly from above and partly from the side.
Figure 22:
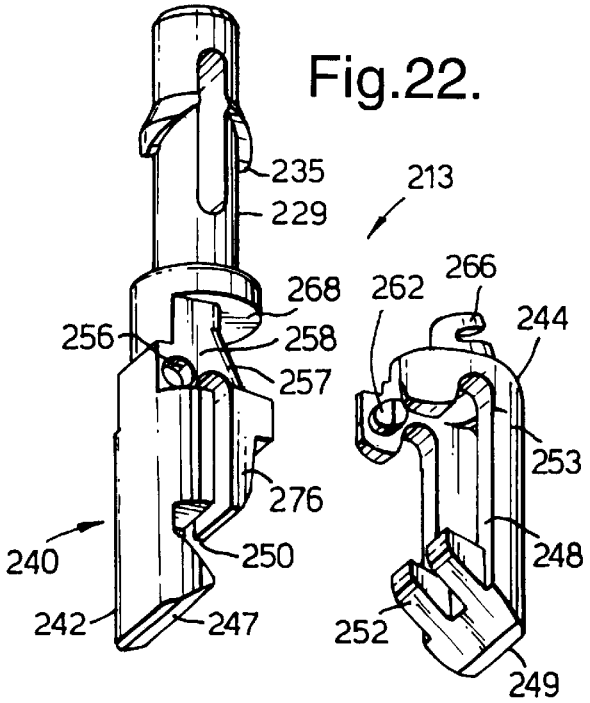
FIG. 22 is an exploded view of the holder of FIGS. 17–21, partly from beneath and partly from the side.

The pivotal connection, generally A, of the first and second legs 242, 244 of the holder 213 is best seen from FIGS. 21–24. This pivotal connection A is provided by a pair of parallel lower arms 254 which are upper extensions of a laterally bifurcated, upper portion 253 of the second leg 244, which are above the first shoulder 252, and which extend generally longitudinally to a pair of round or circular recesses 256. The round recesses 256 are in laterally opposite sides of a longitudinally-elongate intermediate portion 257 of the first leg 242, above its first notch 250, and are adjacent an opposite longitudinal side 246A of the first leg. The longitudinal side of each recess 256, along the opposite longitudinal side 246A of the first leg 242, remote from the second leg 244, is closed. Each recess 256, on its other longitudinal side, closer to the second leg 244, communicates with one of a pair of longitudinally-extending grooves 258 in laterally opposite sides of the intermediate portion 257 of the first leg 242. A laterally-extending, preferably round pivot 262 of each lower arm 254 is laterally inserted in one of the recesses 256, so that the pivots 262 and the second leg 244 can freely rotate about the pivotal connection A and relative to the first leg 242 as shown in FIGS. 18–20.

As also seen from FIGS. 18–20, 21 and 23, a laterally bifurcated, cantilever spring 266 is provided on, and preferably between, the lower arms 254 on the laterally bifurcated, upper portion 253 of the second leg 244. The spring 266 extends longitudinally and upwardly away from the first leg 242. In this regard, a lower or base portion 267 of the spring 266 separates and reinforces the upper portion 253 of the second leg 244. As seen from FIGS. 23 and 24, the base portion 267 of the spring preferably has a generally semi-circular configuration in horizontal cross-section, forming a collar that surrounds the upper portion 245 of the first leg 242, directly above its recesses 256 and grooves 258. The top of the spring 266 is adjacent to a pair of laterally-extending upper stops 268 on laterally opposite sides of a the upper portion 245 of the first leg 242, above its recesses 256 and grooves 258. Each tine of the bifurcated spring 266 is upwardly biased towards one of the upper stops 268, so that the spring urges the second leg 244 towards the first leg 242. As a result, the spring 266 keeps the first shoulder 252 of the second leg 244 biased longitudinally towards the first notch 250 of the first leg 242, thereby keeping the second leg biased towards the closed position of the holder 213. In this regard, the spring 266 can serve to keep different thicknesses of louver 203 clamped securely between the legs 242, 244 (see FIGS. 18–20) and also to restrain swivelling of the louver about its vertical axis.

Preferably, the tines of the bifurcated spring 266 are upwardly biased against the upper stops 268 on the first leg 242, even in the most closed position of the holder 213, shown in FIG. 18. Thereby, the spring 266 is always urging the second leg 244 towards the first leg 242 and towards the closed position of the holder 213. As a result, the legs 242, 244 have to be pried apart in order to insert the upper marginal portion 209 of the louver 203 between them and to hook the aperture 207 on the first shoulder 252.

It is also preferred that the first shoulder 252 extend upwardly somewhat towards the first leg 242 in a closed position of the holder 213 as shown in FIGS. 18–19. Thereby, once the upper marginal portion 209 of the louver 203 is inserted between the legs 242, 244 and the first shoulder 252 is inserted through the aperture 207 in the upper marginal portion of the louver, the weight of the louver on the first shoulder will cause the second leg 244 to be biased towards the first leg 242. This will cause the first shoulder to be urged inwardly of the first notch 250 and will further bias the second leg 244 towards the closed position of the holder 213.

Figure 23:
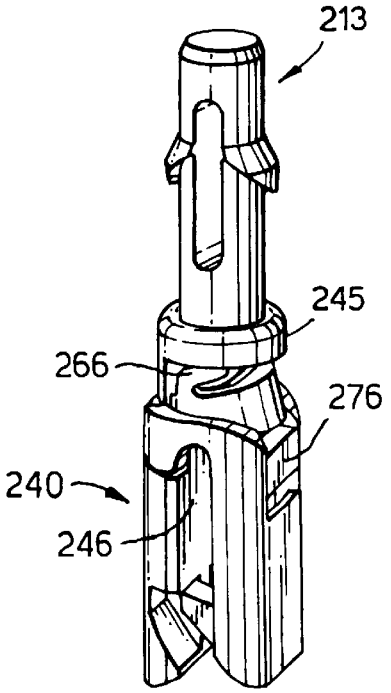
FIG. 23 is a perspective view of the holder of FIGS. 17–22, partly from above and rotated 90 from its position in FIG. 22.
Figure 24:
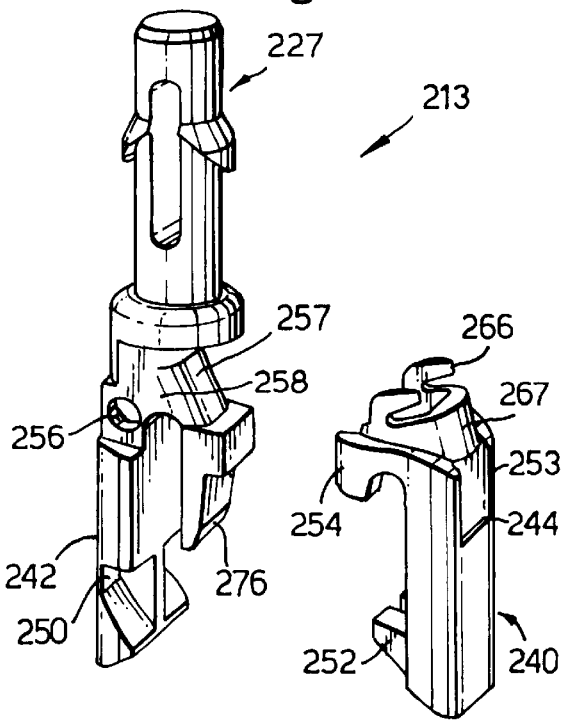
FIG. 24 is an exploded view of the holder of FIGS. 17–23 as shown in FIG. 23.

As further seen from FIGS. 23 and 24, a guide member 276 extends downwardly from the intermediate portion 257 of the first leg 242, between the round recesses 256. The guide member 276 fits closely between the two parts of the laterally bifurcated, upper portion 253 of the second leg 244 and serves to maintain their separation when the second leg pivots relative to the first leg 242 from its open position to its closed position.

FIGS. 25–30 show a fourth embodiment of a holder 313 of the invention, which is similar to the holder 13 of FIGS. 1–8 and for which corresponding reference numerals (greater by 300) are used below for describing the corresponding parts.

Figure 25:
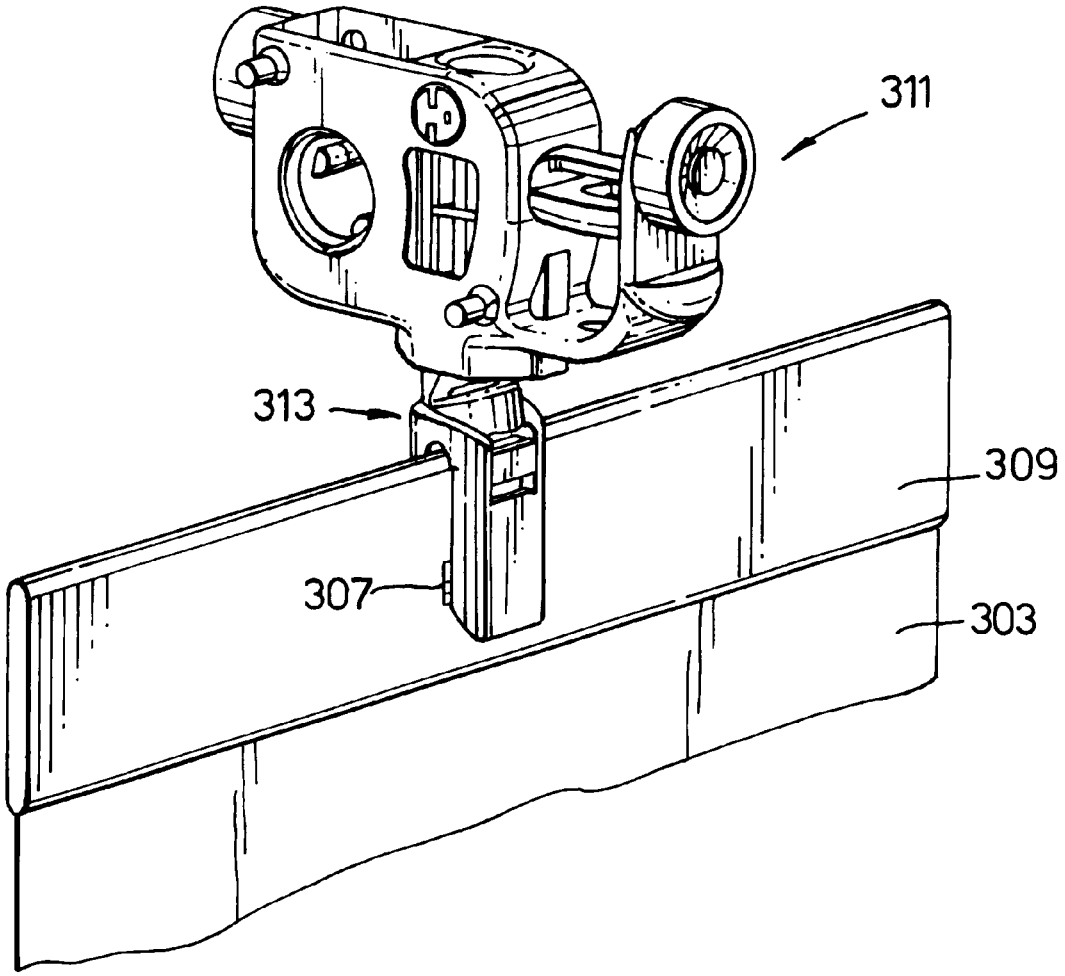
FIG. 25 is a perspective view of a carrier of the head rail of FIG. 1, supporting a single louver with a fourth embodiment of the holder of the invention.

FIG. 25 shows a vertical louver, generally 303, of a vertical blind 301 (not shown). The louver 303 is securely suspended from a carrier, generally 311, of a head rail 305 (not shown) by means of the vertically-extending holder 313 which is attached to the carrier 311 and to an aperture 307 in the upper marginal portion 309 of the louver.

Figure 26:
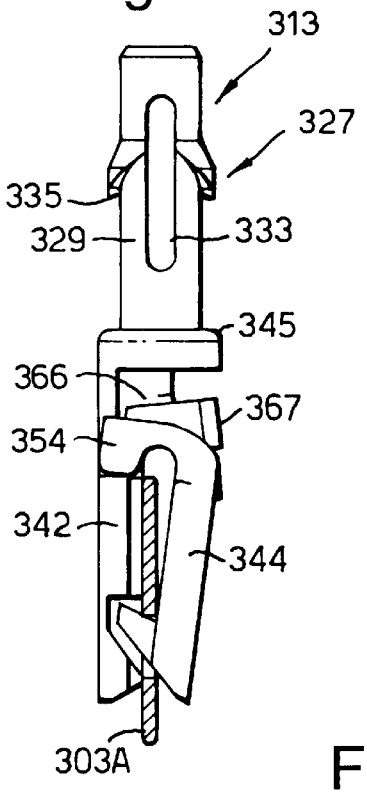
FIGS. 26–28 are side views of the holder of FIG. 25, showing how it can be secured to, and disengaged from, the louver of FIGS. 1, 9, 17 and 25.
Figure 27:
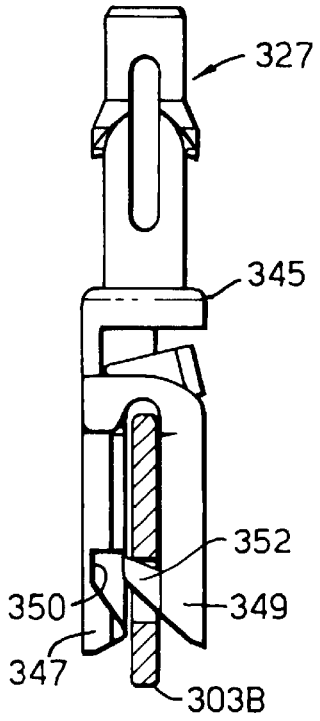
Figure 28:
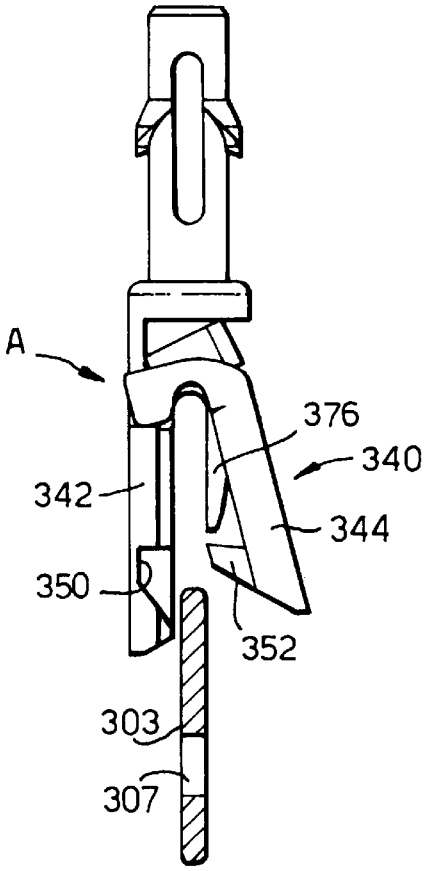
Figure 29:
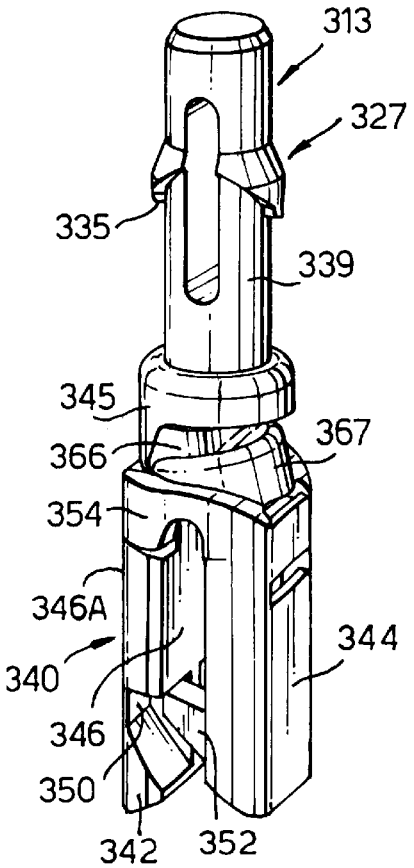
FIG. 29 is a perspective view of the holder of FIGS. 25–28, partly from above and partly from the side.

FIGS. 26–30 show an upper part 327 of the holder 313, held by the carrier 311, and a vertically-extending lower part 340 of the holder 313, holding the louver 303. The lower part 340 of the holder 313 has pivotally-connected, first and second legs 342, 344 which, as shown in FIGS. 26 and 27, can accommodate and securely hold a relatively thin louver 303 A or a relatively thick louver 303B between them. An upper portion 345 of the first leg 342 of the holder 313 is rigidly fixed to the bottom of the upper part 327 of the holder. A first vertically-elongate longitudinally-extending notch 350 is provided in a first longitudinal side 346 of a lower portion 347 of the first leg 342, and a first longitudinally-extending shoulder 352 projects generally perpendicularly from a second longitudinal side 348 (not shown) of a lower portion 349 of the second leg 344. The first shoulder 352 is adapted to be received in the first notch 350 when the second leg 344 is in its closed position, substantially parallel to the first leg 342 and downwardly-extending as shown in FIGS. 25, 26 and 29.

Figure 30:
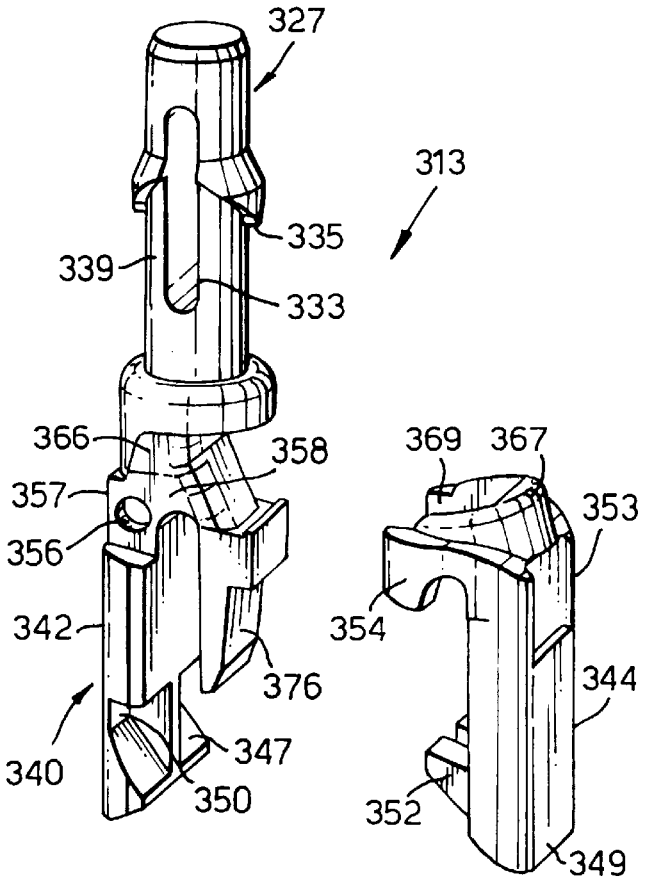
FIG. 30 is an exploded view of the holder of FIGS. 25–29 as shown in FIG. 29.

The pivotal connection, generally A, of the first and second legs 342, 344 of the holder 313 is best seen from FIGS. 29–30. This pivotal connection A is provided by a pair of parallel lower arms 354 which are upper extensions of a laterally bifurcated, upper portion 353 of the second leg 344, which are above the first shoulder 352 of the second leg, and which extend generally longitudinally to a pair of round or circular recesses 356. The round recesses 356 are in laterally opposite sides of a longitudinally-elongate intermediate portion 357 of the first leg 342, above its first notch 350, and are adjacent an opposite longitudinal side 346A (not shown) of the first leg. The longitudinal side of each recess 356, along the opposite longitudinal side 346A of the first leg 342, remote from the second leg 344, is closed. Each recess 356, its other longitudinal side, closer to the second leg 344, communicates with one of a pair of longitudinally-extending grooves 358 in laterally opposite sides of the intermediate portion 357 of the first leg 342. A laterally-extending, preferably round pivot 362 (not shown) of each lower arm 354 is laterally inserted in one of the recesses 356, so that the pivots and the second leg 344 can freely rotate about the pivotal connection A and relative to the first leg 342 as shown in FIGS. 26–28.

Figure 31:
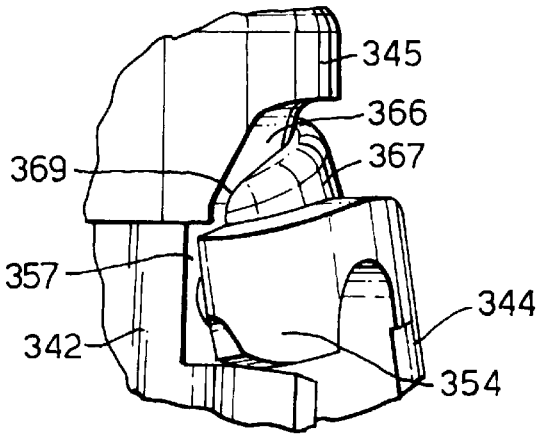
FIG. 31 is a detail perspective view of the holder of FIGS. 25–30, rotated 90 from its position in FIG. 29, showing the connection of the first and second legs.

As best seen from FIGS. 29–31, the upper portion 345 of the first leg 342 has a sloped surface 366 above its recesses 356, preferably on each lateral side of the first leg, particularly at least directly above each recess 356. Each sloped surface 366 is inclined upwardly and laterally outwardly, between the lower arms 354 on the laterally bifurcated, upper portion 353 of the second leg 344. In addition, a collar 367, preferably with a generally semi-circular configuration, is provided on the upper portion 353 of the second leg 344 to separate and reinforce the upper portion of the second leg. The interior surface 369 of the collar 367 closely surrounds each sloped surface 366 of the upper portion 345 of the first leg 342. Preferably, at least laterally opposite sides of the interior surface 369 of the collar 367 closely surround a pair of sloped surfaces 366 on laterally opposite sides of the first leg 342, particularly at least directly above the pivots 362 (not shown) of the second leg 344. The interaction between each sloped surface 366 of the first leg 342 and the surround interior surface 369 of the collar 367 of the second leg 344 keeps the first shoulder 352 of the second leg biased longitudinally towards the first notch 350 of the first leg, thereby keeping the second leg biased towards the closed position of the holder 313. In this regard, each sloped surface 366 of the first leg 342 urges i) the interior surface 369 of the collar 367 on the second leg 344, preferably at least laterally opposite sides of the interior surface of the collar, particularly at least directly above the pivots 362, and ii) also the lower arms 354, attached to the collar, to move laterally apart as the lower arms and the collar are pivoted about the recesses 356 and pivots 362 towards the open position of the holder 313—against the inherent resistance of the material to (preferably plastic), from which the second leg 344 is made. Such inherent resistance of the collar 367 and the lower arms 354 to being laterally spread apart, when the interior surface 369 of the collar is moved upwardly along each sloped surface 366 of the first leg to open the holder 313, serves to keep the holder closed. Thereby, the closed holder 313 clamps different thicknesses of louver 303 securely between its legs 342, 344 (see FIGS. 26–28) and keeps the louver from swivelling about its vertical axis.

Preferably, the interior surface 369 of the collar 367 on the second leg 344 is biased against each sloped surface 366 of the upper portion 345 of the first leg 342, even in the most closed position of the holder 313. Thereby, the collar 367 is always urging the second leg 344 towards the first leg 342 to keep the holder 313 closed. As a result, the legs 342, 344 have to be pried apart in order to insert the upper marginal portion 309 of the louver 303 between them and to hook the aperture 307 on the longitudinally-extending shoulder 352.

It is believed that the angle of the upward and laterally outward inclination of each sloped surface 366 and the separation of each sloped surface 366 from the surrounding interior surface 369 of the collar 367, especially on laterally opposite sides of the collar, particularly directly above the recesses 356 and pivots 362, are not critical and can be varied, so long as the collar 367 is always urging the second leg 344 towards the first leg 342 and the closed position of the holder 313.

It is also preferred that the first shoulder 352 extend upwardly somewhat towards the first leg 342 in a closed position of the holder 313 as shown in FIGS. 26 and 29. Thereby, once the upper marginal portion 309 of the louver 303 is inserted between the legs 342, 344 and the first shoulder 352 is inserted through the aperture 307 in the upper marginal portion of the louver, the weight of the louver on the first shoulder will cause the second leg 344 to be biased towards the first leg 342. This will cause the first shoulder to be urged inwardly of the first notch 350 and will further bias the second leg 344 towards the closed position of the holder 313.

As further seen from FIGS. 29 and 30, a guide member 376 extends downwardly from the intermediate portion 357 of the first leg 342, between the recesses 356. The guide member 376 fits closely between the two parts of the laterally bifurcated, upper portion 353 of the second leg 344 and serves to maintain their separation when the second leg pivots relative to the first leg from its open position to its closed position.

This invention is, of course, not limited to the above-described embodiments which may be modified without departing from the scope of the invention or sacrificing all of its advantages. In this regard, the terms in the foregoing description and the following claims, such as "longitudinal", "lateral", "above", "below", "top", "bottom", "vertical", "horizontal", "upwardly" and "downwardly", have been used only as relative terms to describe the relationships of the various elements of the holder of the invention for vertical sections of architectural coverings. In this regard, the vertical louvers 3,103, 203,303 of the vertical blinds 1,101, 201,301 could be replaced by other vertical sections of an architectural covering, for example; i) by vertical sections of a conventional drapery fabric having apertures in its upper marginal portion, through which the longitudinally-extending shoulders 52, 152, 252,352 of the holders 13, 113, 213,313 can be inserted; or ii) by vertical sections of a vaned fabric as described in PCT publication WO 96/35854, each vertical section having an aperture in the upper marginal portion of the hanger plate in each vane, through which the longitudinally-extending shoulders 52, 152, 252,352 of the holders 13, 113, 213,313 can be inserted; or iii) by vertical vanes as described in PCT publication WO 96/35881, each vane having an aperture in the upper marginal portion of its hanger plate, through which the longitudinally-extending shoulders 52, 152, 252,352 of the holders 13, 113, 213,313 can be inserted.

Likewise, the head rail 5,105, 205,305 could be replaced by a conventional head rail or by one especially adapted to provide improved control of movement of the vertical louvers 3, 103, 203,303 along the length of the head rail and rotation of the vertical louvers about their vertical axes as described, for example, in PCT publication WO 96/35855. Moreover, the upper portion 27, 127, 227,327 of the holder 13, 113, 213,313 could be replaced by other structures, that are conventional, for securely attaching the holder to, and suspending it vertically from, the head rail 5,105, 205,305 so that it can move and rotate.

Furthermore, the first longitudinally-extending notch 50, 150, 250,350 and the recesses 56, 156, 256,356 and grooves 58, 158, 258,358 could be provided on the second leg 44, 144, 244,344 with the first longitudinally-extending shoulder 52, 152, 252,352 and the lower arms 54, 154, 254,354 and their pivots 62, 162, 262,362 then being provided on the first leg 42, 142, 242,343. Likewise, the second vertically-extending shoulder 72 could be provided on the bottom of the first longitudinally-extending shoulder 52, with the second vertically-extending notch 74 then being provided on the top of the first longitudinally-extending notch 50.

Moreover, the upper portion 345 of the first leg 342 can have a sloped surface 366 on a longitudinal side of the first leg 342, closely surrounded by the interior surface 369 of the collar 367 and above the first longitudinal side 346 of the first leg, instead of, or in addition to, a pair of sloped surfaces 366 on laterally opposite sides of the first leg.

I claim:

1. A holder for suspending a vertical section of an architectural covering from a carrier of a horizontally-extending head rail; the holder comprising:

a downwardly-extending first leg;

a generally downwardly-extending second leg that is pivotally connected to the first leg for movement between a first position, in which it extends substantially parallel to the first leg, and a second position, in which it is at an acute angle to the first leg;

the first leg having a first longitudinal side facing the second leg and the second leg having a second longitudinal side facing the first leg;

one of the first and second longitudinal sides, having a longitudinally-extending first notch and the other of the first and second longitudinal sides having a first shoulder projecting at an angle therefrom so as to be received in the first notch when the second leg is in the first position;

the pivotal connection of the first and second legs defining a pivot axis and extending laterally and being located above the first notch and the first shoulder; and a connector configured to attach the first leg to the carrier, the connector located, above the pivotal connection; and a spring member, the spring member configured to resiliently bias the second leg towards the first leg, the spring member integrally formed with one of the first and second leg, but distinguishable from either leg.

2. The holder of claim 1 wherein the first leg has a longitudinally-elongate intermediate portion that is above the first notch and the first shoulder and that has a pair of laterally opposite sides, through which the pivotal connection passes; and the second leg has two parallel arms that are above the first notch and the first shoulder and that extend longitudinally at least to the pivotal connection.

3. The holder of claim 2 wherein one of: i) the pair of laterally opposite sides of the intermediate portion and ii) facing lateral side portions of the two parallel arms have a pair of recesses about the pivotal connection; and the other one of: i) the pair of laterally opposite sides of the intermediate portion and ii) facing lateral side portions of the two parallel arms have a pair of laterally-extending pivots along the pivotal connection; each pivot being laterally inserted in one of the recesses.

4. The holder of claim 3 wherein each parallel arm carries one of the pivots and has a longitudinal end with a polygonal longitudinal profile and wherein each recess is vertically elongated, whereby the pivots can be moved to vertical extremities of the grooves, so as to move the second leg downwardly relative t the first leg when the first shoulder is in the first notch.

5. The holder of claim 4 wherein the longitudinally side of each recess, remote from the second leg, is open and wherein longitudinally adjacent the open longitudinal sides of the pair of recesses are means for resiliently abutting against the longitudinally ends of the arms when the pivots are inserted in the recesses.

6. The holder of claim 4 or 5 wherein a vertically-extending second notch is in the bottom of one or the first notch and the first shoulder; and a vertically-extending second shoulder is on the bottom of the other of the first notch and the first shoulder; the second shoulder being adapted to be inserted vertically into the second notch, when the second leg is in the first position, by moving the second leg downwardly relative to the first leg, whereby the second leg cannot move from the position to the second position.

7. The holder of claim 6 wherein the first notch is in the first longitudinal side of the first leg; the parallel arms are on the second leg; the second notch is in the bottom of the first shoulder; and the second shoulder is on the bottom of the first notch.

8. The holder of claim 3 wherein each parallel arm carries one of the pivots and each recess is generally round.

9. The holder of claim 3 or 8 wherein on the bottom of the intermediate portion of the first leg, adjacent an opposite longitudinal side of the second leg, are means for resiliently abutting against the opposite longitudinal side of the second leg.

10. The holder of claim 9 wherein the spring extends downwardly to about the first notch and is longitudinally biased towards the first notch to keep the first shoulder of the second leg biased towards the first notch.

11. The holder of claim 3 or 8 wherein on the arms are means for resiliently abutting against a laterally-extending upper stop on the first leg, above the recesses so that the second leg is resiliently held in the first position.

12. The holder of claim 11 wherein the means for resiliently abutting comprises a spring and wherein a lower portion of the spring separates and reinforces a laterally bifurcated, upper portion of the second leg, on which are the arms.

13. The holder of claim 12 wherein the spring is a laterally bifurcated, cantilever spring, each time of which is upwardly biased towards one of a pair of the upper stops on laterally opposite sides of the first leg.

14. The holder of claim 11 wherein the spring is a laterally bifurcated, cantilever spring, each time of which is upwardly biased towards one of a pair of the upper stops on laterally opposite sides of the first leg.

15. A holder for suspending a vertical section of an architectural covering from a carrier of a horizontally-extending head rail; the holder comprising:

a downwardly-extending first leg;

a generally downwardly-extending second leg that is pivotally connected to the first leg for movement between a first position, in which it extends substantially parallel to he first leg, and a second position, in which it is an acute angle to the first leg;

the first leg having a first longitudinally side facing the second leg and the second leg having a second longitudinal side facing the first leg;

one of the first and second longitudinal sides, having a longitudinally-extending first notch and the other of the first and second longitudinal sides having a first shoulder projecting at an angle therefrom so as to be received in the first notch when the second leg is in the first position;

the pivotal connection of the first and second legs extending laterally and being located above the first notch and the first shoulder; and means on the first leg, above the pivotal connection, for attaching the first leg to the carrier;

wherein (1) the first leg has a longitudinally-elongate intermediate portion that is above the first notch and the first shoulder and that has a pair of laterally opposite sides, through which the pivotal connection passes; and the second leg has two parallel arms that are above the first notch and the first shoulder and that extend longitudinally at least to the pivotal connection, (2) one of the pair of laterally opposite sides of the intermediate portion and facing lateral side portions of the two parallel arms have a pair of laterally-extending pivots along the pivotal connection, each pivo being laterally inserted in one of the recesses, and (3) a sloped surface on the first leg above its recesses, on at least one of its laterally opposite sides, particularly at least directly above each recess, is inclined upwardly and laterally outwardly between the arms, and wherein a collar, having a substantially semi-circular configuration, is on the second leg and has an interior surface, on at least one of its laterally opposite sides, particularly at least directly above its pivots, which closely surrounds the sloped surface, so that the second leg is resiliently held in the first position.

16. The holder if claim 15 wherein the sloped surface urges the interior surface of the collar and the arms to move laterally apart as the arms and the collar are pivoted about the recesses and pivots towards the second position.

17. A head rail for an architectural covering comprising: the holder of any one of claims 1–5 or 8; a carrier to which the holder is coupled; and a framework in which the carrier is slideably received.

18. An architectural covering comprising: the holder of any one of claims 1–5 or 8; a carrier to which the holder is coupled; a framework in which the carrier is slideably received; and a louver that is attached to the holder.

19. A holder for suspending a vertical section of an architectural covering from a carrier of a horizontally-extending head rail; the holder comprising:

a downwardly-extending first leg;

a generally downwardly-extending second leg that is coupled with the first leg at a pivotal connection for movement between a first position, in which it extends substantially parallel to the first leg, and a second position, in which it is at an acute angle to the first leg;

the first leg including (i) a first longitudinal side facing the second leg and (ii) a sloped surface located above the pivotal connection, the sloped surface extending upwardly and laterally outwardly;

the second leg including (i) a second longitudinally side facing the first leg and (ii) a resilient collar having substantially semi-circular configuration, the collar having an interior surface that is generally in contact with the sloped surface, wherein the second leg is biased in the first position;

one of the first and second longitudinal sides having a longitudinally-extending first notch and the other of the first and second longitudinal sides having a first shoulder projecting at an angle therefrom so as to be received in the first notch when the second leg is in the first position;

the pivotal connection of the first and second legs extending laterally and being located above the first notch and the first shoulder; and a connector configured to attach the first leg to the carrier, the connector located above the pivotal connection.

20. The holder of claim 1, wherein the spring member further comprises a laterally extending open collar integral with one of the first and second legs, the open collar (i) having an interior surface and (ii) at least partially encompassing a portion of the other of the first or second legs when the first and second leg are pivotally connected, the other of the first and second legs having a sloped surface that extends upwardly and laterally outwardly, at least a portion of the interior surface of the collar being biased against the sloped surface, whereby the second leg is encouraged into the first position.

21. A holder for suspending a vertical section of an architectural covering from a carrier of a horizontally-extending head rail, the holder comprising:

a first component, the first component including (i) a connector portion configured for attachment to the carrier, and (ii) a substantially vertical first leg extending downwardly from the connector portion; and a second component, the second component defining a generally vertical second leg with a top end, the second component being coupled with the first component by a single pivotal connection defining a pivot axis and, the single pivotal connection located proximate the top end of the second component and proximate an intersection between the connector portion and the first leg of the first component;

wherein (i) the first and second legs eaech have a longitudinally extending inside surface, the inside surface of the first leg facing the inside surface of the second leg, one of the longitudinally extending inside surfaces having a shoulder projecting at an angle therefrom towards the other inside surface, and (ii) the second arm is biased by a spring member being operably connected with either or both of the first and second legs.

22. The holder of claim 21, wherein the longitudinally extending inside surface facing the longitudinally extending inside surface with the projecting shoulder has a notch disposed therein, the notch configured to receive at least a portion of the projecting shoulder.

23. The holder of claim 21, wherein the spring member is integral with either the first or second component and is distinguishable from the leg associated withe the first or second component.

24. The holder of claim 21, wherein the spring member is an open collar having an inside surface, the open collar being attached with either the first or second component above the pivot connection, the inside surface biased against one or more other surfaces on the other of the first and second component, at least one surface of the one or more other surfaces being sloped upwardly and outwardly.

25. The holder of claim 24, wherein the open collar is integrally formed and unitary with the either the first or second component.

26. The holder of claim 25, wherein the open collar is integrally and unitary with the first component.

27. The holder of claim 1, wherein there is only a single pivotal connection betweent he first and second legs.

* * * * *